US010207499B2

(12) United States Patent
Franzoso et al.

(10) Patent No.: US 10,207,499 B2
(45) Date of Patent: Feb. 19, 2019

(54) DROP VELOCITY ABERRANCY DETECTION

(71) Applicant: HEWLETT-PACKARD DEVELOPMENT COMPANY, L.P., Houston, TX (US)

(72) Inventors: Mauricio Seras Franzoso, Sant Cugat del Valles (ES); Antonio Gracia Verdugo, Barcelona (ES); Marta Coma Vives, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/544,400

(22) PCT Filed: Feb. 27, 2015

(86) PCT No.: PCT/US2015/018044

§ 371 (c)(1),
(2) Date: Jul. 18, 2017

(87) PCT Pub. No.: WO2016/137501

PCT Pub. Date: Sep. 1, 2016

(65) Prior Publication Data

US 2018/0001626 A1 Jan. 4, 2018

(51) Int. Cl.
*B41J 2/11* (2006.01)
*B41J 2/21* (2006.01)
(Continued)

(52) U.S. Cl.
CPC ..... *B41J 2/04561* (2013.01); *B41J 2/0451* (2013.01); *B41J 2/125* (2013.01);
(Continued)

(58) Field of Classification Search
CPC ..... B41J 2/045; B41J 2/04561; B41J 2/165; B41J 2/2139; B41J 2/21421
See application file for complete search history.

(56) References Cited

U.S. PATENT DOCUMENTS 4,509,057 A 4/1985 Sohl et al.
5,124,720 A * 6/1992 Schantz ..... B41J 2/2139 347/19
(Continued)

FOREIGN PATENT DOCUMENTS

CN 1671555 9/2005
CN 1903574 1/2007
(Continued)

OTHER PUBLICATIONS

Filmore, G., "Drop Velocity From an Ink-jet Nozzle", IEEE Transaction on Industry Applications, vol. 1A-19, No. 6, pp. 1098-1103, Nov. 1983.

*Primary Examiner* — Julian D Huffman
(74) *Attorney, Agent, or Firm* — HP Inc. Patent Department

(57) ABSTRACT

Examples associated with drop velocity aberrancy detection are disclosed. One example includes firing ink through nozzles of a print-head past sensors to identify drop velocities of the nozzles. A target drop velocity is selected based on the drop velocities of the nozzles. An aberrant nozzles is detected when a nozzle has a drop velocity that deviates from the target drop velocity by a selected threshold. The aberrant nozzle is deactivated, and a good nozzle that will travel over locations traversed by the aberrant nozzle is configured to print portions of a job that would have been printed by the aberrant nozzle.

15 Claims, 5 Drawing Sheets

(51) Int. Cl.

| | |
|---|---|
| ***B41J 2/045*** | (2006.01) |
| ***B41J 2/125*** | (2006.01) |
| ***B41J 2/135*** | (2006.01) |
| ***B41J 2/165*** | (2006.01) |

(52) U.S. Cl.

CPC ..... *B41J 2/135* (2013.01); *B41J 2/165* (2013.01); *B41J 2/2139* (2013.01); *B41J 2/2142* (2013.01); *B41J 2/0458* (2013.01); *B41J 2/04581* (2013.01); *B41J 2/11* (2013.01); *B41J 2/16579* (2013.01)

(56) References Cited

U.S. PATENT DOCUMENTS

| | | | | |
|---|---|---|---|---|
| 6,102,512 | A | 8/2000 | Torii et al. | |
| 6,629,747 | B1 | 10/2003 | King et al. | |
| 6,644,772 | B2 | 11/2003 | Choi | |
| 2002/0008723 | A1 | 1/2002 | Wen et al. | |
| 2002/0171699 | A1 | 11/2002 | Choi | |
| 2003/0132981 | A1 | 7/2003 | Arakawa et al. | |
| 2004/0095410 | A1* | 5/2004 | Miyashita ..... | B41J 2/0451 347/19 |
| 2004/0196321 | A1 | 10/2004 | Eguchi et al. | |
| 2007/0024661 | A1 | 2/2007 | Kim et al. | |
| 2009/0027431 | A1 | 1/2009 | Lee et al. | |
| 2009/0244141 | A1 | 10/2009 | Govyadinov et al. | |
| 2009/0244163 | A1 | 10/2009 | Govyadinov | |
| 2011/0279505 | A1 | 11/2011 | Shin et al. | |

FOREIGN PATENT DOCUMENTS

| | | |
|---|---|---|
| CN | 101372180 | 2/2009 |
| JP | 2010131827 | 6/2017 |
| KR | 20090063001 | 6/2009 |

* cited by examiner

DROP VELOCITY ABERRANCY DETECTION

BACKGROUND

Printing mechanisms fire drops of printing fluid (e.g., ink) onto a print medium (e.g., paper) to generate an image. These mechanisms may be used in a wide variety of applications, including computer printers, plotters, copiers, facsimile machines, and so forth. A printing apparatus may include a print head having a plurality of independently addressable firing units. Each firing unit may include a fluid chamber connected to a fluid source and to a fluid outlet nozzle. A transducer within the fluid chamber provides the energy for firing fluid drops from the nozzles. In some printers, the transducers are thin-film resistors that generate sufficient heat during application of a voltage pulse to vaporize a quantity of printing fluid. This vaporization is sufficient to fire a fluid drop out of the nozzle and onto the print medium.

BRIEF DESCRIPTION OF THE DRAWINGS

The present application may be more fully appreciated in connection with the following detailed description taken in conjunction with the accompanying drawings, in which like reference characters refer to like parts throughout, and in which.

DETAILED DESCRIPTION

Systems, methods, apparatuses, and equivalents associated with drop velocity aberrancy detection are described. Drop velocity aberrancy detection may be achieved by measuring drop velocities of nozzles of a print head. A range of drop velocities may be selected so that most nozzles have a drop velocity within the range. The range may be based on, for example, the mean and standard deviation of drop velocities of nozzles. Nozzles having drop velocities outside the selected range may be deactivated to reduce banding when the print head is used to print a document. The portions of the document that would have been printed by deactivated nozzles may then be assigned to nozzles having drop velocities within the selected range.

Figure 1:
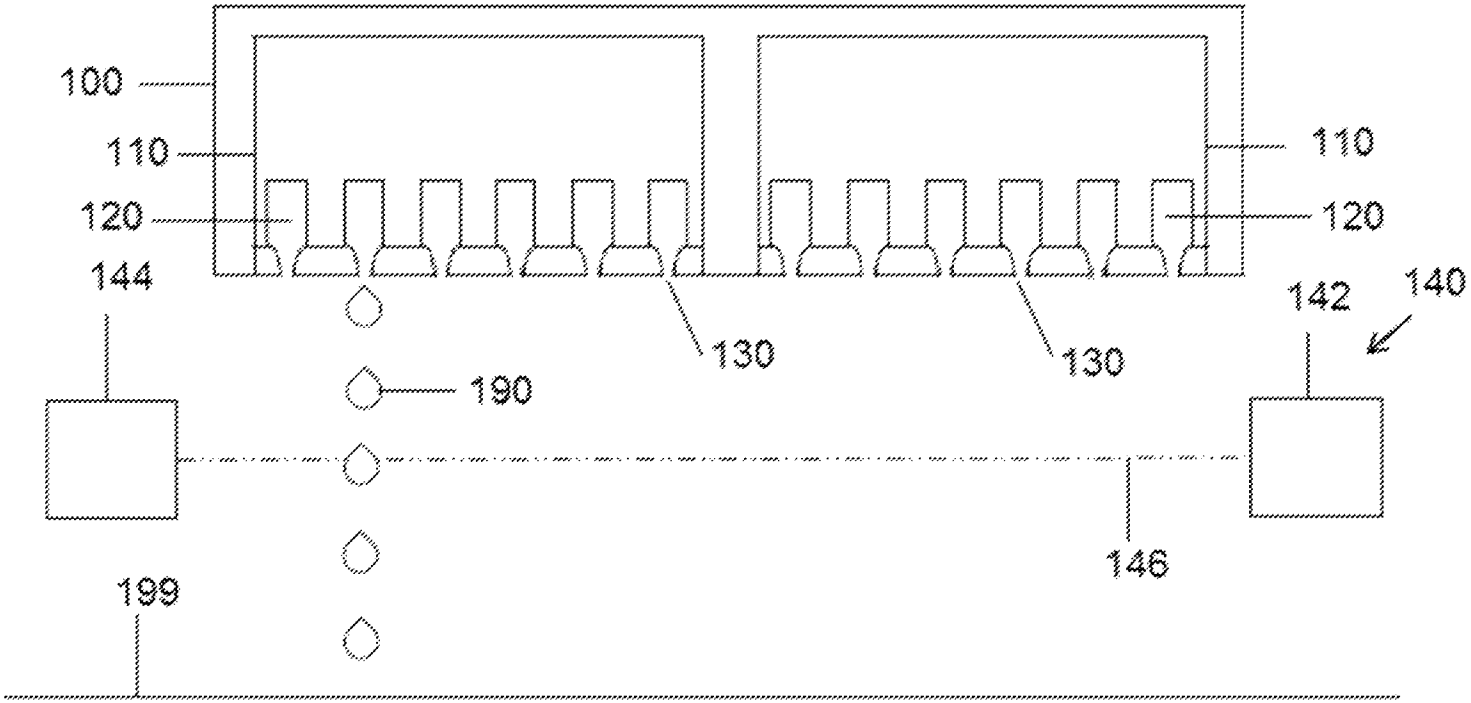
FIG. 1 illustrates an example printer in which example apparatus systems, and methods, and equivalents, may operate.

FIG. 1 illustrates an example printing apparatus 100 in which example apparatuses, systems, methods, and equivalents, may operate. In this example, printing apparatus 100 comprises a plurality of print heads 110. In other examples printing apparatus 100 may comprise one print head 110.

In this example, each print head 110 comprises a plurality of nozzles 130 for firing a printing fluid (e.g., ink, other types of printing fluids) onto a print medium 199. Each nozzle 130 is connected to a separate fluid chamber 120, which receives printing fluid from a fluid source (not shown). In some examples, each fluid chamber 120 may be connected to a separate fluid source; in other examples, a plurality of fluid chambers 120 may share a fluid source (e.g., an ink of a particular color).

When printing apparatus 100 includes a plurality of print heads 110, the common fluid source of a print head 110 may be shared among a plurality of print heads 110. In other examples, each print head 110 may have its own common fluid source for the plurality of nozzles 130 such that each print head can print with different printing fluids.

Each fluid chamber 120 comprises a transducer. The transducer may be, for example, a thin-film resistor for heating printing fluid in the fluid chamber 120. In other examples, the transducer may be a piezoelectric transducer. In order to print, printing fluid is transferred from the fluid source to fluid chambers 120. A voltage pulse is applied to transducer, creating a pressure pulses in printing fluid in chambers 120, causing fluid drops 190 to be fired from nozzles 130 connected to chambers 120 and towards print medium 199.

A series of voltage pulses can be applied to the transducer at a certain frequency, referred to as the firing frequency, to fire at least one fluid drop from the print head 110, in this case from nozzle 130, at this firing frequency. By controlling the width and amplitude of each voltage pulse, the quantity of printing fluid in each fired fluid drop can be controlled; for example, increasing the amplitude or width of an applied voltage pulse will increase the quantity of printing fluid in a fired fluid drop.

When print head 110 is initially manufactured, transducers and nozzles 130 may be designed so that the nozzles 130 fire ink droplets 190 at a certain drop velocity. Over time, drop velocities of nozzles 130 may degrade for a variety of reasons. For example, kogation, a buildup of debris on the transducer, may result in less efficient energy transfer when generating drops 199 fired from nozzles 130. Further, the drop velocities of nozzles 130 may degrade at different rates depending on, for example, whether some nozzles 130 are used more often than others, and so forth. By way of illustration, nozzles 130 in the middle of print head 110 may be used more than nozzles 130 at extremes of print head 110. When drop velocities of nozzles 130 differ by too much, printing defects such as banding may begin to appear in documents printed by printing apparatus 100, In addition to being an image quality defect in printing, a user operating printing apparatus 100 may have no way to diagnose or debug banding issues, and banding issues may appear with little to no warning. This may lead the user to waste, ink, media, time, money, and so forth, without solving the banding issue, because printing apparatus 100 may indicate to the user that print head 110 is operating normally and does not need to be replaced.

To mitigate these issues, nozzles 130 having aberrant drop velocities may be deactivated to prevent banding. To measure drop velocities of nozzles 130, printing apparatus 100 also includes a drop detector 140 arranged to measure parameters of fluid drops 199 fired by print head 110. These parameters may include, for example, drop velocities, and whether nozzles are firing drops 190 in various examples, drop detector 140 may comprise a light source 142 for producing a beam of light 146 incident on a photodetector 144. Fluid drops 190 fired from nozzles 130 crossing light beam 146 will interrupt the light, for example by absorbing and/or scattering the light, thus changing the amount of light incident on the photodetector. This may allow measuring the time it takes for drops 190 fired from nozzles 130 to cross beam of light 146. In combination with a known distance between nozzles 130 and beam of light 146, the velocity of drops 190 may be measured for various nozzles 130.

Once drop velocities of each nozzle 130 has been measured, a range of drop velocities may be selected that will limit banding when printing a document onto print medium 199. The range may be selected, for example, by identifying a mean drop velocity for nozzles 130 in print head 110, and a standard deviation in the drop velocities for nozzles 130. In some cases (e.g., when print heads 110 are relatively new), absolute values may be combined with relative values (e.g., the mean and standard deviation) to limit unnecessary deactivation of nozzles. Nozzles 130 outside the selected range may be classified as aberrant and at least temporarily deactivated. Other nozzles 130 may then be configured to print portions of the document that would have been printed by nozzles classified as aberrant Specifically, good nozzles that pass over the same locations as the aberrant nozzles may be configured to print the portions of the document the deactivated nozzles would have printed.

It is appreciated that, in the following description, numerous specific details are set forth to provide a thorough understanding of the examples. However, it is appreciated that the examples may be practiced without limitation to these specific details. Also, the examples may be used in combination with each other.

"Module", as used herein, includes but is not limited to hardware, instruction (e.g., firmware, software) stored on a computer-readable medium or in execution on a machine, and/or combinations of each to perform a function(s) or an action(s), and/or to cause a function or action from another module, method, and/or system. A module may include a software controlled microprocessor, a discrete module (e.g., ASIC), an analog circuit, a digital circuit, a programmed module device, a memory device containing instructions, and so on. Modules may include gates, combinations of gates, or other circuit components. Where multiple logical modules are described, it may be possible to incorporate the multiple logical modules into one physical module. Similarly, where a single logical module is described, it may be possible to distribute that single logical module between multiple physical modules.

Figure 2:
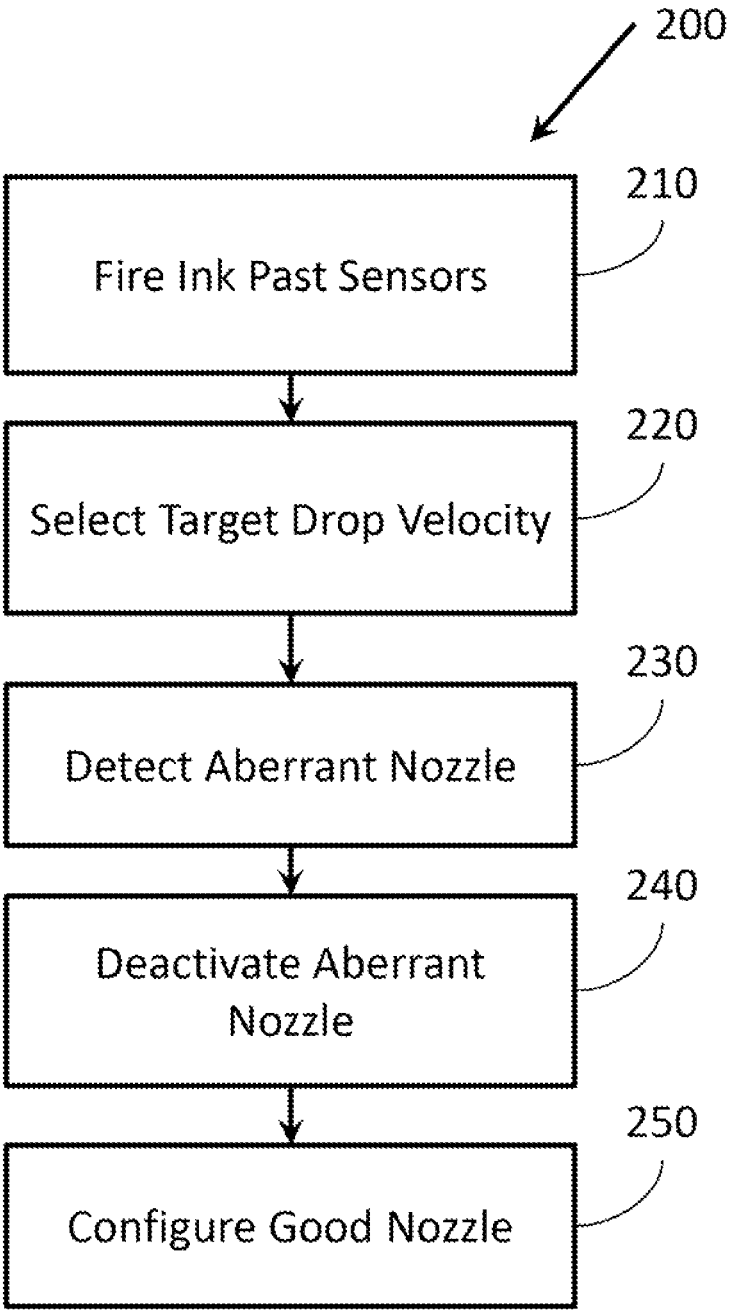
FIG. 2 illustrates a flowchart of example operations associated with drop velocity aberrancy detection

FIG. 2 illustrates an example method 200 associated with drop velocity aberrancy detection. Method 200 may be embodied on a non-transitory computer-readable medium storing computer-executable instructions. The instructions, when executed by a computer may cause the computer to perform method 200. In other examples, method 200 may exist within logic gates and/or RAM of an application specific integrated circuit.

Method 200 includes firing ink through nozzles at 210. The ink may be fired past respective sensors at 210. The nozzles and the sensors may belong to a print head. Firing ink past the sensors may facilitate identifying drop velocities of the nozzles. The sensors may be, for example, optical sensors. The sensors may also detect when nozzles have a zero drop velocity, indicating when nozzles are not firing. Detecting when a nozzle is not firing may facilitate replacement of non-firing nozzles with firing nozzles. Specifically, upon detecting a non-firing nozzle, a firing nozzle may be configured to print a portion of a document that would have been printed by the non-firing nozzle.

Method 200 also includes selecting a target drop velocity at 220. The target drop velocity may be selected based on drop velocities of the nozzles. In one example, the target drop velocity may be the mean of the drop velocities of the nozzles. Note, that selecting a target drop velocity based on current drop velocities of nozzles is different from selecting an absolute target drop velocity. An absolute target drop velocity may result in a nozzle being deactivated after degrading past a certain drop velocity without regard to how the nozzle compares to other nozzles. As nozzles in print heads often degrade (e.g., due to kogation) at similar rates over time, deactivating nozzles with drop velocities that deviate from the current mean drop velocity may increase the lifespan of the print head, while reducing banding related to nozzles having differing drop velocities.

Method 200 also includes detecting an aberrant nozzle at 230. The aberrant nozzle may be a nozzle whose drop velocity deviates from the target drop velocity by a selected threshold. In the example where the target drop velocity is the mean drop velocity of the nozzles, the selected threshold may be generated based on the mean of the drop velocities and on the standard deviation of the drop velocities. In various examples, the aberrant nozzle may have a drop velocity greater than the target drop velocity plus the selected threshold or a drop velocity less than the target drop velocity minus the selected threshold. Consequently, the aberrant nozzle may have a drop velocity considered either too high or too low when compared to other nozzles in the print head. It is worth noting that though a nozzle may have a drop velocity considered too low at one point in time, the drop velocity of the nozzle may eventually again fall within the range of nozzles considered good as the other nozzles degrade.

In one example, the nozzles may fire ink of a single color. Consequently, nozzles firing different colored ink may belong to differing sets of nozzles for the purpose of identifying aberrant nozzles.

Method 200 also includes deactivating the aberrant nozzle at 240. Method 200 also includes configuring a good nozzle at 250. A good nozzle may be a nozzle that has not been deactivated as an aberrant nozzle. Additionally, a good nozzle may also be a nozzle that has not been deactivated for another reason. By way of illustration, a nozzle that was detected as not firing at all by a sensor would not be a suitable candidate to be treated as a good nozzle. The good nozzle may be a nozzle that will travel over locations traversed by the aberrant nozzle. The good nozzle may be configured to print portions of a job that would have been printed by the aberrant nozzle.

Figure 3:
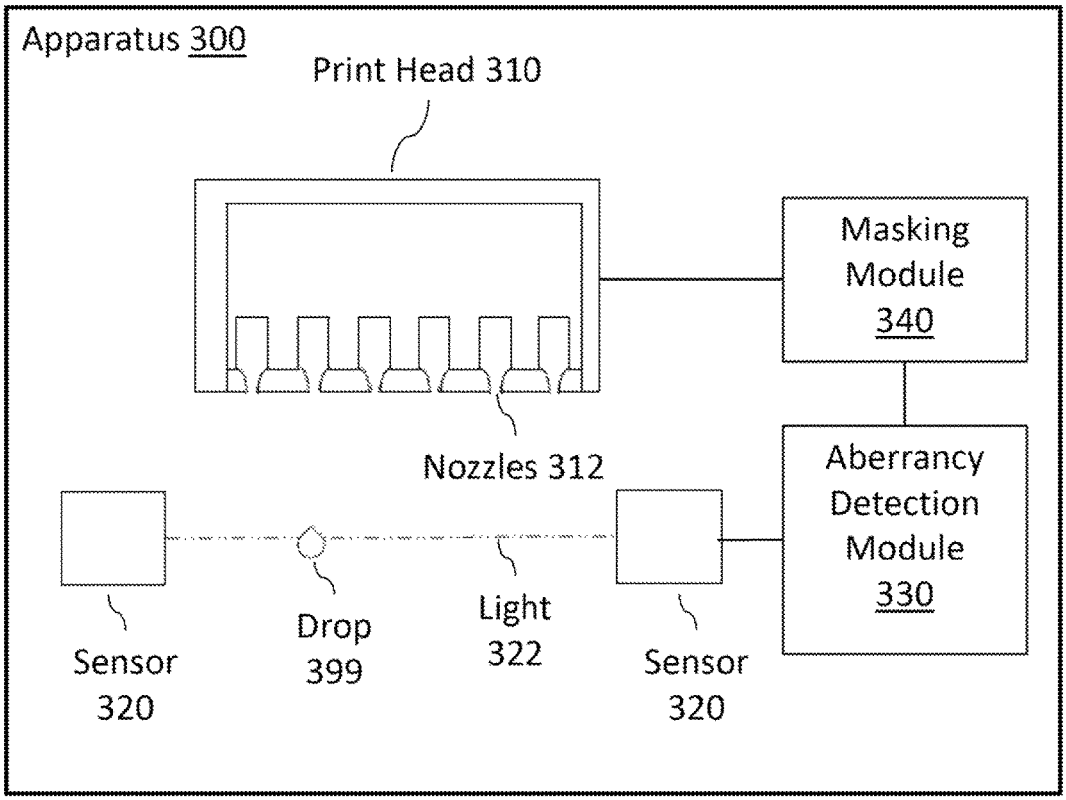
FIG. 3 illustrates an example apparatus associated with drop velocity aberrancy detection.

FIG. 3 illustrates an apparatus 300. Apparatus 300 includes a print head 310. Print head 310 includes nozzles 312. Apparatus 300 also includes optical sensors 320. The optical sensors may measure drop velocities of firing nozzles 312. As described above, when a drop 399 of ink is fired from a nozzle 312, drop 399 may pass through a beam of light 322. Drop 399 passing through the beam of light 322 may be detected by a sensor 320, allowing calculation of a time difference between when drop 399 was fired from nozzle 312 and when drop 399 passed through beam of light 322. In combination with the distance between nozzle 312 and beam of light 322, the velocity of drop 399 may be determined Optical sensors 320 may also detect when nozzles 312 are non-firing nozzles.

Apparatus 300 also includes an aberrancy detection module 330. Aberrancy detection module 330 may identify a range of drop velocities that will limit banding when printing a print job. The range of drop velocities may be determined based on the drop velocities of firing nozzles 312. The range of drop velocities may be generated based on a mean drop velocity of firing nozzles. The range of drop velocities may also be generated based on a standard deviation in drop velocities of firing nozzles. Aberrancy detection module 330 may also classify a nozzle 312 as an aberrant nozzle. A nozzle 312 may be classified as an aberrant nozzle when the nozzle has a drop velocity outside the range of drop velocities.

Apparatus 300 also includes a masking module 340. Masking module 340 may configure a replacement nozzle. The replacement nozzle may be configured to print a portion of the print job that would have been printed by the aberrant nozzle. The replacement nozzle may also be configured to print a portion of the print job that would have been printed by the replacement nozzle, prior to configuration of the replacement nozzle to print the portion of the print job that would have been printed by the aberrant nozzle. This may mean that the replacement nozzle is effectively printing two or more portions of the document. In some examples, the portion of the print job that would have been printed by the aberrant nozzle may be divided between several good nozzles to limit degradation of the good nozzles. In the example where optical sensors 320 detect when nozzles 312 are non-firing nozzles, masking module 340 may also configure a replacement nozzle to print a portion of the print job that would have been printed by non-firing nozzles.

Figure 4:
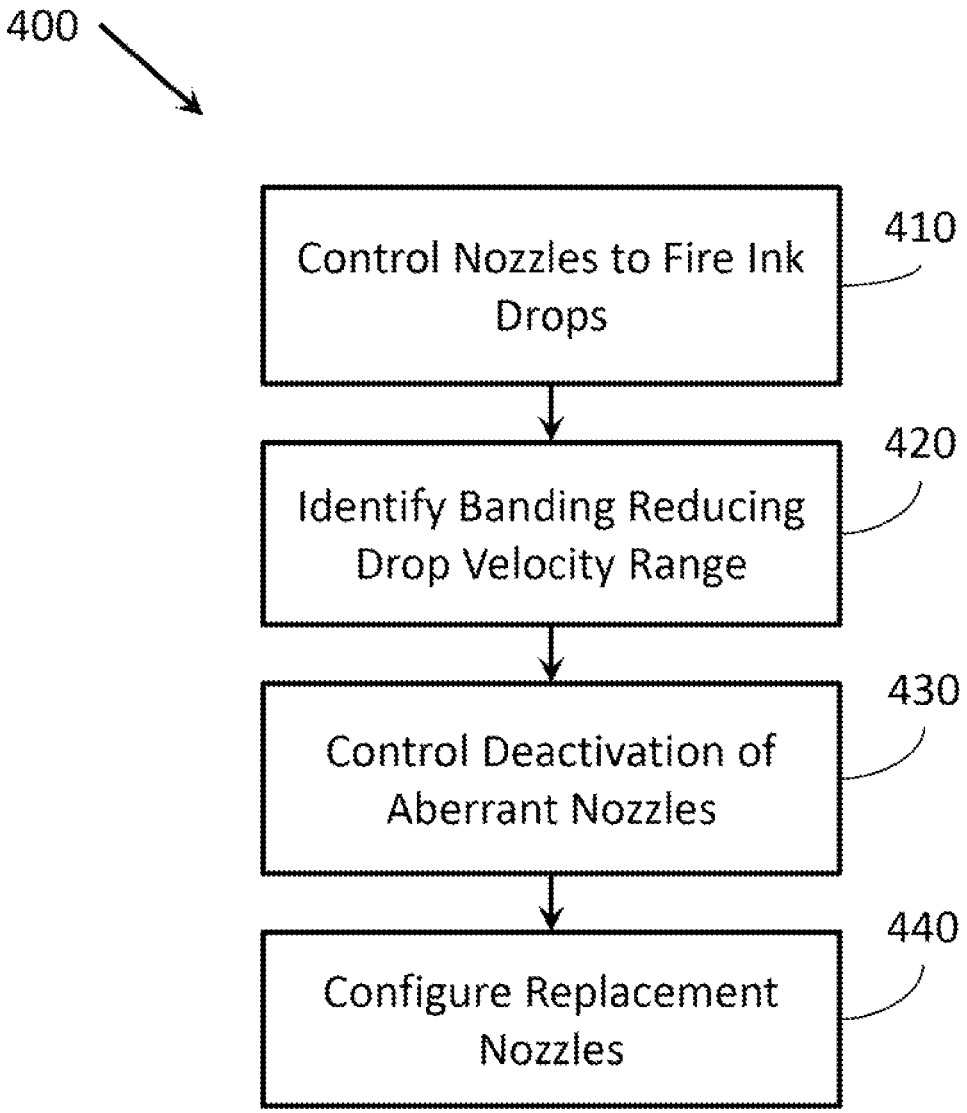
FIG. 4 illustrates another flowchart of example operations associated with drop velocity aberrancy detection.

FIG. 4 illustrates a method 400. Method 400 may be embodied on a non-transitory computer-readable medium storing computer-executable instructions. The instructions, when executed by a computer may cause the computer to perform method 400. In other examples, method 400 may exist within logic gates and/or RAM of an application specific integrated circuit.

Method 400 includes controlling nozzles of a print head to fire ink drops at 410. The ink drops may be fired a known distance through an optical sensor. Firing the ink drops through the optical sensor may facilitate detecting drop velocities of the nozzles.

Method 400 also includes identifying a banding reducing drop velocity range at 420. The banding reducing drop velocity range may be identified based on drop velocities of the nozzles. The banding reducing drop velocity range may be determined based on a number of deviations from a mean drop velocity of the nozzles.

Method 400 also includes controlling deactivation of aberrant nozzles on the print head at 430. An aberrant nozzle may be a nozzle having a drop velocity outside the banding reducing drop velocity range.

Method 400 also includes configuring replacement nozzles at 440. A replacement nozzle may be configured for each aberrant nozzle. Each replacement nozzle may be configured to print a portion of a document that would have been printed by a respective aberrant nozzle. Replacement nozzles may be selected to mitigate further degradation of the print head. Consequently, if a choice exists between two potential replacement nozzles, the replacement nozzle having the higher drop velocity may be selected as the replacement nozzle to ensure a more uniform degradation of the print head.

Figure 5:
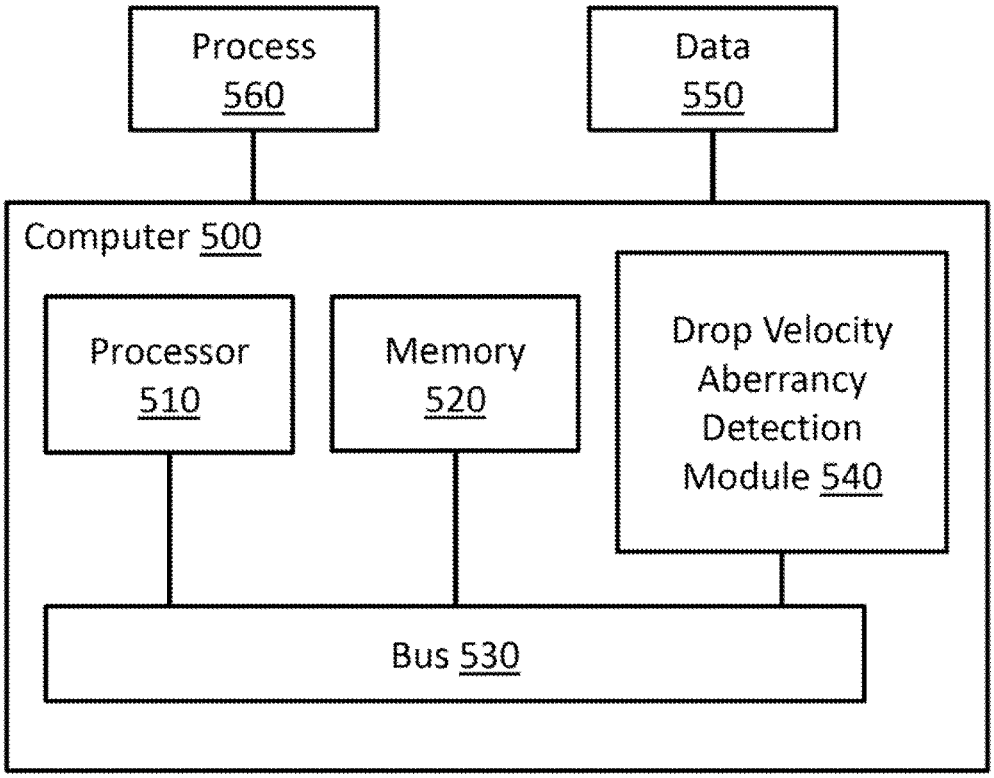
FIG. 5 illustrates an example computing device in which example systems and methods, and equivalents, may operate.

FIG. 5 illustrates an example computing device in which example systems and methods, and equivalents, may operate. The example computing device may be a computer 500 that includes a processor 510 and a memory 520 connected by a bus 530. The computer 500 includes a drop velocity aberrancy detection module 540. In different examples, drop velocity aberrancy detection module 540 may be implemented as a non-transitory computer-readable medium storing computer-executable instructions, in hardware, software, firmware, an application specific integrated circuit, and/or combinations thereof.

The instructions may also be presented to computer 500 as data 550 and/or process 560 that are temporarily stored in memory 520 and then executed by processor 510. The processor 510 may be a variety of various processors including dual microprocessor and other multi-processor architectures. Memory 520 may include non-volatile memory (e.g., read only memory) and/or volatile memory (e.g., random access memory). Memory 520 may also be, for example, a magnetic disk drive, a solid state disk drive, a floppy disk drive, a tape drive, a flash memory card, an optical disk, and so on. Thus, memory 520 may store process 560 and/or data 550. Computer 500 may also be associated with other devices including other computers, peripherals, and so forth in numerous configurations (not shown).

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest cope consistent with the principles and novel features disclosed herein.

What is claimed is:

1. A method, comprising:

firing printing fluid through nozzles of a print head past respective sensors to identify drop velocities of nozzles;

selecting a target drop velocity based on the drop velocities of the nozzles;

detecting an aberrant nozzle whose drop velocity deviates from the target drop velocity by a selected threshold;

deactivating the aberrant nozzle; and configuring a replacement nozzle that has a respective drop velocity that is higher than other replacement nozzles that will travel over locations traversed by the aberrant nozzle to print portions of a job that would have been printed by the aberrant nozzle.

2. The method of claim 1, where the target drop velocity is a mean of the drop velocities of the nozzles.

3. The method of claim 2, where the selected threshold is selected based on the mean of the drop velocities and on a standard deviation of the drop velocities.

4. The method of claim 1, where the drop velocity of the aberrant nozzle is one of, greater than the target drop velocity plus the selected threshold, and less than the target drop velocity minus the selected threshold.

5. The method of claim 1, where the nozzles includes nozzles that fire ink of a single color.

6. The method of claim 1, where the replacement nozzle has not been deactivated.

7. The method of claim 1, where the sensors are optical sensors that are also to detect when the nozzles have a zero drop velocity to facilitate replacement of non-firing aberrant nozzles with replacement nozzles.

8. An apparatus, comprising:

a print head having nozzles;

optical sensors to measure drop velocities of respective nozzles;

an aberrancy detection module to identify a range of drop velocities that will limit banding when printing a print job based on the drop velocities of the nozzles, and to classify as an aberrant nozzle, a nozzle having a drop velocity outside the range of drop velocities; and a masking module to configure a replacement nozzle that has a respective drop velocity that is higher than other replacement nozzles to print a portion of the print job that would have been printed by the aberrant nozzle.

9. The apparatus of claim 8, where the range of drop velocities is generated based on a mean drop velocity of the nozzles and a standard deviation in drop velocity of the nozzles.

10. The apparatus of claim 8, where the replacement nozzle is also to print a second portion of the print job that would have been printed by the replacement nozzle, prior to configuration of the replacement nozzle to print the portion of the print job that would have been printed by the aberrant nozzle.

11. The apparatus of claim 8, where the optical sensors are also to detect when respective nozzles are non-firing nozzles, and where the masking module is also to configure a replacement nozzle to print a portion of the print job that would have been printed by a non-firing nozzle.

12. The apparatus of claim 8, where drop velocity is to be measured for a nozzle by measuring a time between sending an instruction for the nozzle to fire and receiving a signal from a respective sensor that the nozzle has fired.

13. A non-transitory computer-readable medium storing computer-executable instructions that when executed by a computer cause the computer to:

control nozzles of a print head to fire ink drops a known distance through an optical sensor to detect drop velocities of the nozzles;

identify a banding reducing drop velocity range based on the drop velocities of the nozzles;

control deactivation of aberrant nozzles on the print head having a drop velocity outside the banding reducing drop velocity range; and configure replacement nozzles for each aberrant nozzle, where each replacement nozzle that has a respective drop velocity that is higher than other replacement nozzles for a respective aberrant nozzle is to print a portion of a document that would have been printed by the respective aberrant nozzle.

14. The non-transitory computer-readable medium of claim 13, where the replacement nozzles are selected to mitigate degradation of the print head.

15. The non-transitory computer-readable medium of claim 13, where the banding reducing drop velocity range is determined based on a number of deviations from a mean drop velocity of the nozzles.

* * * * *